United States Patent [19]

Ernest

[11] 4,104,011

[45] Aug. 1, 1978

[54] I-BEAM APEX SEAL

[75] Inventor: Robert P. Ernest, Dearborn Heights, Mich.

[73] Assignee: Ford Motor Company, Dearborn, Mich.

[21] Appl. No.: 754,662

[22] Filed: Dec. 27, 1976

Related U.S. Application Data

[63] Continuation-in-part of Ser. No. 458,378, Apr. 5, 1974, abandoned.

[51] Int. Cl.[2] ..... F01C 19/04; F01C 21/08

[52] U.S. Cl. ..... 418/121; 418/123

[58] Field of Search ..... 418/113, 119–124, 418/267, 268; 277/81 P

[56] References Cited

U.S. PATENT DOCUMENTS

| | | | |
|---|---|---|---|
| 3,171,587 | 3/1965 | Schaller et al. | 418/124 |
| 3,176,909 | 4/1965 | Maurhoff | 418/123 |
| 3,207,426 | 9/1965 | Gassmann et al. | 418/124 |
| 3,400,691 | 9/1968 | Jones | 418/121 |

FOREIGN PATENT DOCUMENTS

| | | | |
|---|---|---|---|
| 1,189,785 | 3/1965 | Fed. Rep. of Germany | 418/122 |

*Primary Examiner*—John J. Vrablik

*Attorney, Agent, or Firm*—Joseph W. Malleck; Olin B. Johnson

[57] ABSTRACT

A rotary internal combustion engine is disclosed having an apex seal assembly of the type that allows for lateral length adjustment. The assembly has an unexposed seal body portion received in a slot of the rotor, the body portion has a depth at least three times the height of the seal crown (exposed portion of seal) and is configured relative to the slot to provide a gas flow throat area to the underside of the body which is critically regulated. Grooves are defined in the leading and trailing sides of the unexposed body to reduce body portion mass by at least 20%, to reduce the uninterrupted body side wall contact area with the slot side wall by at least 40% thereby to increase unit sealing pressure and to create lands along the sides of said unexposed body portion which are short in depth to create a short flow throat equal to or less than 0.04 inch in depth. Symmetrical means is disposed in said rotor for communicating chamber pressure on the opposite sides of said seal through said rotor with the respective grooves for applying a vector force sufficient to stably move the seal body to or from the leading or trailing slot position with substantially no time lag in the variance of pressure beneath the seal and that of the highest pressure on either side of the seal.

The seal configuration eliminates gas leakage that would occur if the seal crown were allowed to leave the epitrochoid chamber surface during a seal shift, (b) eliminates gas leakage between the side of the seal body and a slot side wall that are intended to be sealingly engaged, and (c) reduces gas leakage that travels under the seal between chambers during a seal shift.

5 Claims, 25 Drawing Figures

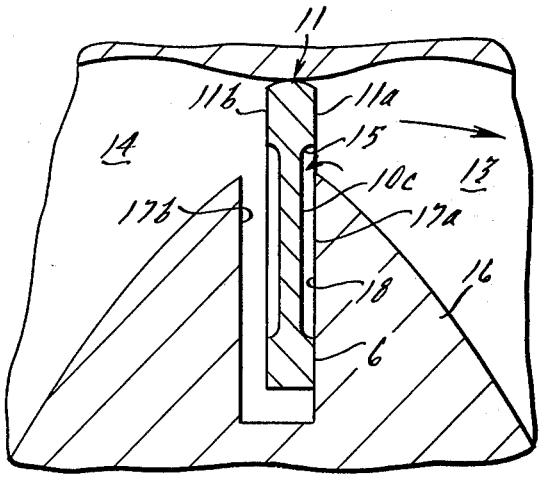
FIG. 11.
PRIOR ART
PRIOR ART
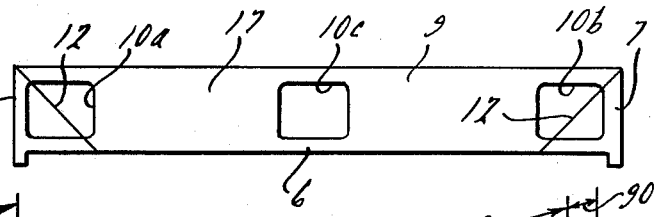
FIG. 12.
FIG. 13.
PRIOR ART
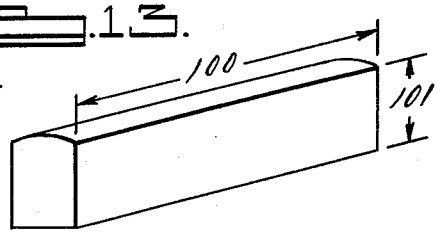
FIG. 14.
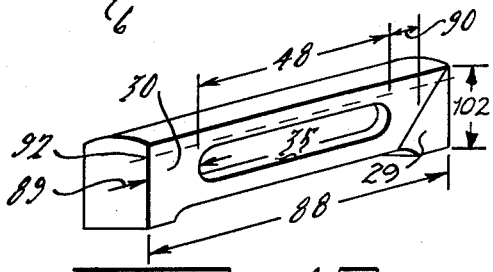
FIG. 17.
FIG. 18.
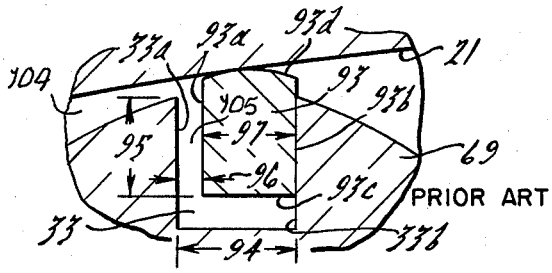
PRIOR ART
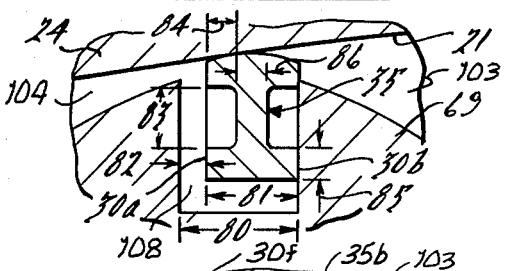
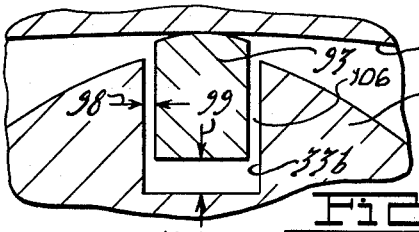
PRIOR ART
FIG. 15.
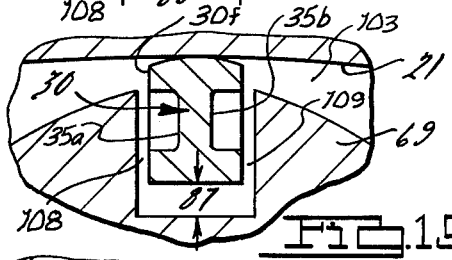
FIG. 19.
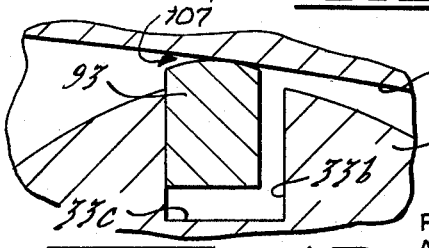
PRIOR ART
FIG. 16.
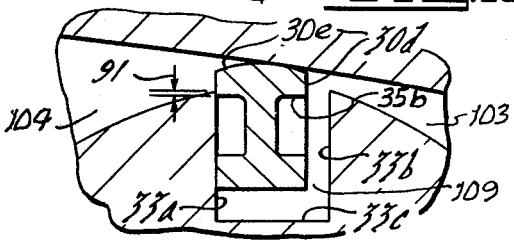
FIG. 20.

Invention

I-BEAM APEX SEAL

REFERENCE TO RELATED APPLICATIONS

This is a continuation-in-part of U.S. Ser. No. 458,378 filed Apr. 5, 1974, now abandoned.

BACKGROUND OF THE INVENTION

One of the most critical problems associated with a rotary internal combustion engine is leakage at the seal grid of a rotor. Highly efficient dynamic sealing is mandatory between apices of the rotor and its surrounding housing if the engine is to have performance and efficiency better than current commercial automative engines. Various factors contribute to the lack of an adequate solution in this area: housing distortion due to wide variations in local operating temperature, the gas-actuated apex seal loses effectiveness at points where the source of gas pressure shifts its orientation with respect to the seal, and the factor that the apex seal is alternately dragged and pushed against the rotor housing during different quadrants of movement. Seal grid leakage ultimately affects cranking efficiency, speed, fuel economy, low-end torque and unburned hydrocarbon emission levels.

Prior art seal constructions to date have typically comprised a strip of material, such as cast iron or graphite, received in a transverse slot at each of the apices of the rotor; each strip has a curved crown to make a line contact with the rotor housing. The strip is urged into engagement with the rotor housing by a combination of three forces: a mechanical spring working radially outwardly against the base of the strip, centrifugal force, and combustion gas pressure. The latter is the most predominant force that affects sealing. Sealing is designed to take place along the crown line contact and along a line or surface contact at one side of the strip with one side of the slot. The lateral tolerance between the strip and slot has been arranged with some looseness requiring the strip to shift from one slot side to the other to effect a new sealing mode as pressure shifts during a full revolution of the rotor. High gas pressure, performing as the workhorse among the three seal forces, will be on different sides of the strip at different quadrants of rotor movement.

Various attempts have been made to solve the leakage problem by a metallurgical approach which has involved substitution of a variety of materials to obtain more stable operating conditions. Although some improvement has been noted by this approach, it is now more widely acknowledged that a solution, if there is one, resides in a mechanical design approach. To this end, prior art mechanical attempts (such as U.S. Pat. No. 3,172,767) have included making a three-piece seal strip with 45° angled surfaces between mating ends of the pieces thereby allowing the seal strip to laterally accommodate different dimensions between the housing side walls abutting the open ends of the slots. However, the mechanical spring must act against the remote end pieces, leaving the center piece without the same radial forces operating to urge it against the rotor housing. This can result in a considerable gap or slit between the crown of the center piece and the trochoid surface when a pressure relief may occur during seal shifts, thus allowing gas leakage to dramatically reduce efficiency of the engine.

The prior art has also made some attempt to overcome leakage during seal shifts, or more accurately, reduce the time lag for gas pressure to shift the seal within the slot. It has been generally accepted by one approach that cocking or skewing of the apex seal strip within the slot is a necessary phenomenon; therefore non-symmetrical passages, communicating with the bottom side of the seal, are useful to promote gas communication. This construction is further discussed in the detailed description, but suffice it to say that it is not successful in reducing the time lag to avoid gas leakage.

Still another prior art approach (illustrated in U.S. Pat. No. 3,176,909) to solving the time lag problem, also detailed in the specification, has been to provide a shuttle element immediately below the apex seal strip which in turn is spring urged to act against the apex seal for sealing with the rotor housing. Slots are provided in the rotor penetrating through the sides of the seal slot to communicate gas pressure to the shuttle and thereby force the shuttle transversely to promote a seal between the sides of the shuttle and the slot. However, due to spring friction against the shuttle and the large surface contact between the shuttle and the strip itself, there has been no reduction of the time lag for the seal shift. In fact, it has been hindered by this particular construction.

Yet still another approach is illustrated in U.S. Pat. No. 3,171,587, which provides openings in the rotor body to communicate gas pressure with the mid-section of the leading and trailing seal strip side walls, the seal strip being unmodified. This is disadvantageous because the mass of the seal strip remains unimproved, the orifice area through which gas pressure communicates with the underside of the seal remains the same while the length of said orifice is undesirably variable depending on the quadrant position of the rotor. The unit pressure force holding said seal against a slot side wall is slightly improved. In another embodiment of this patent, the seal strip body and crown have small recesses extending above the rotor slot walls which communicate directly with chamber pressure. This is disadvantageous because the recesses must be made inherently small to leave sufficient body metal as a guide to maintain the body upright in the slot; thus body mass remains substantially the same, unit pressure holding the seal against the wall remains low, and the flow orifice is insufficient if the walls between lands defined by the recesses as well as the lands are considered as the throat walls. In addition, leakage paths are promoted by placing the recesses in a position straddling camming surfaces (during momentary seal shifts); when the underside pressure does not remain high enough, the camming surfaces will part slightly).

SUMMARY OF THE INVENTION

A primary object of this invention is to provide a seal grid system for a rotary internal combustion engine which is effective to improve the operating efficiency and fuel economy for such engine over any competitive rotary engine construction known to date. In substance, it is an object to provide an apex seal which realistically does seal.

Another object of this invention is to provide an apex seal system for a rotary internal combustion engine which substantially improves the flow orifice communication between the seal strip and bottom zone of the seal slot, and eliminates friction between the seal strip and the surrounding receptacle and/or apex seal spring to result in a reduction of the time lag for shifting the seal during different quadrants of movement; in addition, it is an object to reduce the normal apex seal spring force without sacrificing sealing efficiency. To this end, the construction should also have communicating means symmetrical with respect to the apex seal and eliminate cocking or skewing of the apex seal strip during all phases of operation within the rotor slot.

Particular features pursuant to the above objects comprise: the proportioning of the width of the seal strip and slot width to provide a flow orifice width of between 0.001 and 0.003 inch; providing grooves in the seal strip body below the upper extremity of the slot to (a) substantially reduce the seal mass without affecting alignment of the seal within the slot, (b) define a short land surface providing an ultra short flow orifice, and (c) reduce the interengaging surface area between the seal body and slot side wall for increasing the unit pressure force holding interengagement more tightly.

SUMMARY OF THE DRAWINGS

FIGS. 11 and 12 are views of still another prior art embodiment;

FIGS. 13–16 illustrate the most conventional of prior art embodiments in various operating positions;

FIGS. 17–20 are views similar to FIGS. 13–16 but illustrating the inventive embodiment;

DETAILED DESCRIPTION

The dynamic problems associated with the apex seal of a rotary internal combustion engine are rather unique compared to other internal combustion engines. The apex seals are conventionally activated to seal by gas pressure from either of the two adjacent combustion chambers on either side thereof. Because of the necessary close tolerance between the apex seal strip thickness (the transverse width of strip from leading to trailing sides) and the slot within which it is received in the rotor, there is a time lag in communicating a shift in the locus of the highest combustion chamber gas pressure to the underside of the apex seal. This time lag may allow the apex seal strip to momentarily leave the rotor housing surface. This results in a hammering effect between the apex seal strip and the rotor housing which induces "chatter." That is to say, the normal centrifugal force and spring pressure force, working radially outwardly to urge the apex seal strip into engagement with the rotor housing, are changed so that in fact there is a slight centripetal force acting at a location close to the minor axis of the epitrochoid. Thus, the lack of the highest gas pressure under the seal can provide an unstable force condition which allows the seal to move away from the rotor housing surface. This repeated leaving and returning to the surface results in a series of chatter marks which develop into serious grooves over a period of use making it almost impossible to provide a satisfactory seal in an engine of such character.

Figure 3:
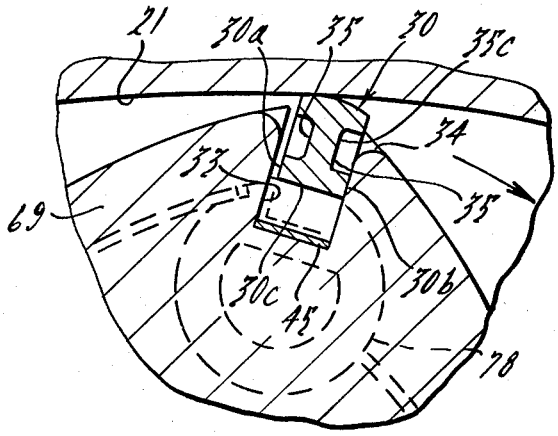
FIG. 3 is a cross-sectional view taken substantially along lines 3—3 of FIG. 1 illustrating the apex seal in the leading position.
Figure 5:
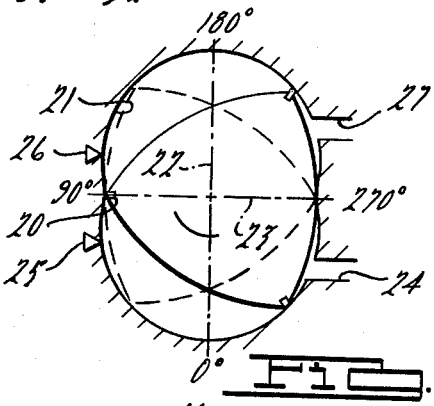
FIG. 5 is a schematic layout of the quadrants of the epitrochoid wall for relating the leading and trailing positions of the apex seal assembly thereto.
Figure 4:
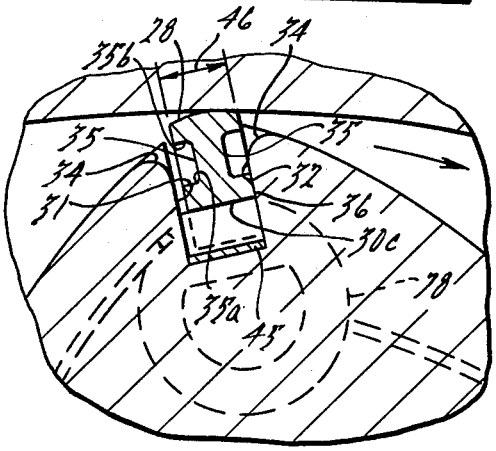
FIG. 4 is a cross-sectional view similar to FIG. 3 illustrating the apex seal in one trailing position.
Figure 6:
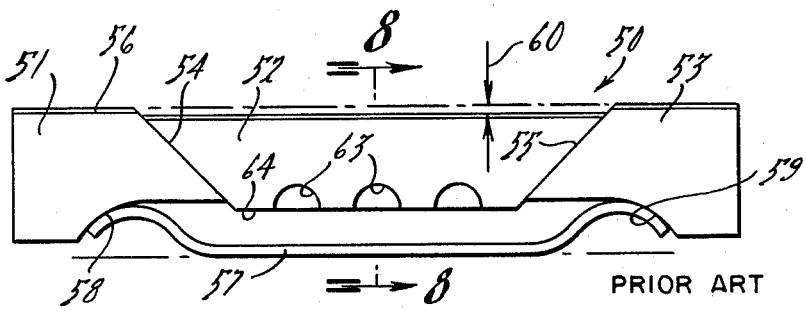
PRIOR ART FIG. 6.
FIGS. 6–9 illustrate one prior art embodiment, FIGS. 6 and 7 being elevational and plan views, FIGS. 8 and 9 being sectional views showing respectively trailing and leading positions.
Figure 7:
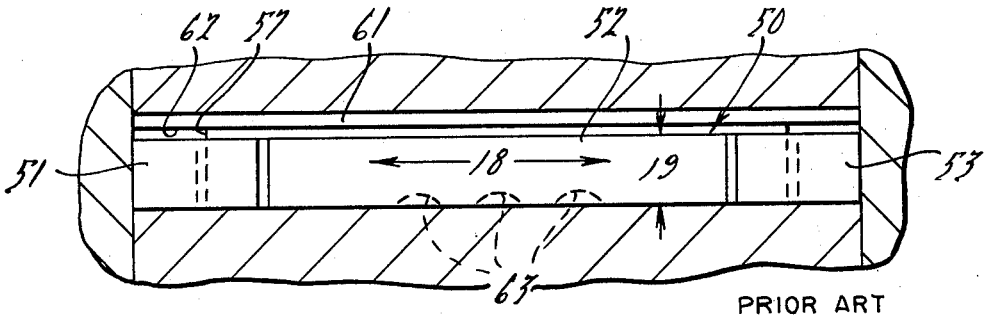
PRIOR ART FIG. 7.
Figure 8:
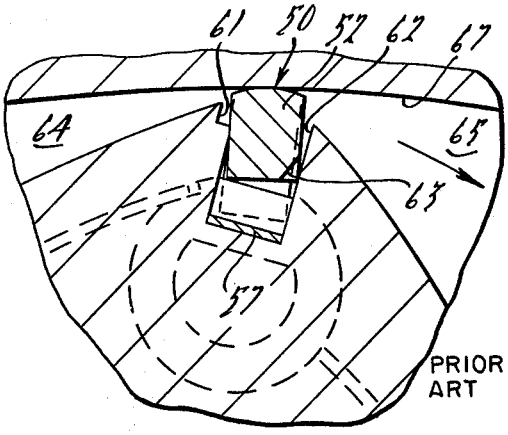
PRIOR ART FIG. 8.

A full understanding of the dynamic problems associated with an apex seal requires recognition not only of the fact that the apex seal strip typically makes a line contact between the curved crown portion of the seal strip and the epitrochoid rotor housing, but also that the line contact moves over the crown portion of the seal through an included angle of approximately 46° with respect to the radius of the rotor while the latter moves through a 360° revolution. As best shown in FIG. 5, the apex seal 20 at 90° is normal or perpendicular to the epitrochoid surface 21 defined by major and minor axes 22 and 23. If 0° is designated as the intersecting point of the major axis with the surface 21 between the intake port 24 and the trailing spark plug 25, then 90° is the intersecting point of the minor axis 23 with surface 21 between the two spark plugs 25 and 26, 180° is the intersecting point of the major axis between the leading spark plug 26 and the exhaust port 27, and 270° is the intersecting point of the minor axis between the exhaust and intake ports 27 and 24 respectively. Because the apex seal oscillates plus or minus 23° from its normal position within the slot containing it, it lags the rotor during the 0° to 90° and 180° to 270° quadrants (see FIG. 4) and leads the rotor during the 90° to 180° and 270°–360° (or 0°) quadrants (see FIG. 3). During the two quadrants in which the apex seal lags the rotor, it is dragged across the epitrochoid surface by the rotor. During the two quadrants in which the apex seal leads the rotor, the prior art seals tend to dig into the epitrochoid surface 21; in the 90°–180° quadrant the seal is rubbing against the hottest part of the epitrochoid surface and is unstable due to the time lag between the changing gas pressure phenomenon. As the result, chatter occurs which destroys the epitrochoid surface smoothness and causes excessive wear of the apex seal itself. Significant loss of chamber gas pressure occurs and unburned gases are allowed to escape from the exhaust port causing a significant increase in unburned hydrocarbons in the exhaust gases.

The chatter problem has been such a continuing perplexing one to the design of a satisfactory rotary internal combustion engine, that a computerized program was undertaken by the inventor to simulate apex seal dynamics and establish a firm fundamental understanding of the factors which are causing such problem. It was hoped that the results of such computer program would provide some insight into the chatter problem which has heretofor been moderately overcome only by the use of expensive and difficult to finish epitrochoid coatings and seal materials.

Considerable speculation has occurred in the literature as to how the gas pressure operates behind the apex seal. Since the gas forces acting on the seal are, in general, of an order of magnitude higher than any of the other forces, such as the seal spring 45 or centrifugal forces, it is important to have a reliable estimate of their magnitude. To this end (test structure not illustrated), two transducers were mounted in the engine to sense gas pressure, one being located beneath the apex seal itself and the other in an opening in the rotor housing. The first was a piezoelectric transducer mounted in the front rotor of a two-rotor engine, beneath one of the apex seal grooves; a small hole communicated the bottom of the apex seal groove with the pressure sensitive face of the transducer. A slip ring and brush arrangement was devised to transmit the pressure signal from the transducer to the outside of the engine, with the slip ring mounted on the front face of the front rotor and the brush mounted in the front end plate. The second pressure transducer was installed in the front rotor housing next to the leading spark plug hole where the pressures in the leading and lagging chambers become approximately equal. With this set up, the two pressure signals were fed to the two channels of an oscilliscope, operated in a chopped mode, allowing a direct comparison of apex seal back pressure with the appropriate combustion chamber pressure.

Figure 21:
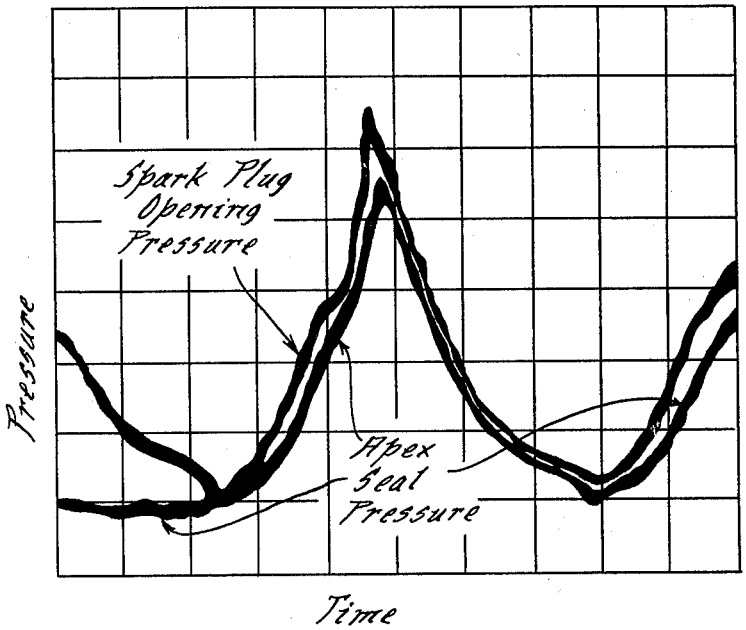
Prior Art FIG. 21.
FIGS. 21 and 22 are oscilloscope trace representations showing pressure buildup in the combustion chamber and beneath the apex seal assembly, the former trace for a prior art construction and the latter trace for the inventive construction herein.
Figure 22:
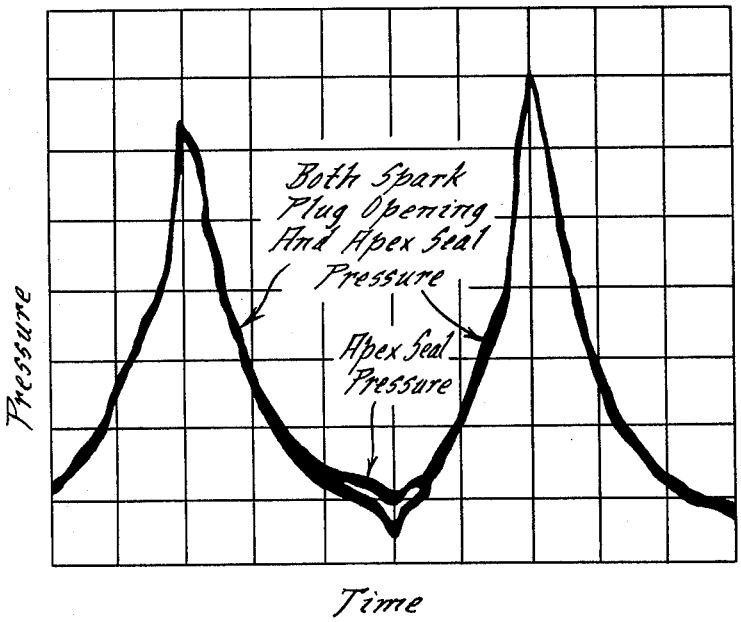

Ideally, the two oscilliscope traces should follow each other identically if perfect sealing is taking place. FIGS. 21 and 22 show comparative traces for an engine with and without the use of the present invention (which involves critical gas orifice dimensioning permitting flow between the slot and seal critical area interengagement between the seal and slot walls, and critical mass proportioning of the seal). This analysis confirmed the following observations. The gas pressure behind or underneath the apex seal was found to be generally the higher of the two combustion chamber pressures to which the seal is subjected on the leading or lagging sides. The seal becomes firmly seated on the trailing side of the groove during the compression and expansion events in the leading chamber. Shortly after the exhaust port opens to the leading chamber, the apex seal transfers to the leading side of the groove in response to the increasing compression pressure in the lagging chamber and remains in this position for the balance of the compression and expansion events in the lagging chamber. Unfortunately, there is a time delay in the buildup and decay of pressure in the higher pressure chamber for all prior art seal structures such as the one depicted in FIGS. 6–9 which rendered the pressure plots of FIG. 21. It is clear from such time lag that, for prior art constructions, there is sufficient leakage of gas through the apex seal side and top clearances to the volume on the opposite side of the seal to provide ineffective gas actuation of the seal.

Ideally the gas pressure beneath the apex seal should track or trace identically the plot of gas pressure adjacent the spark plug opening. That this does not occur with an apex seal construction illustrated in FIGS. 6–9 which was used for the data of FIG. 21, is evident. That this does occur with the construction of this invention is evident from FIG. 22. Some slight non-identity is observable in FIG. 7, but this is due to trapped gases beneath the apex seal during the shift, which trapped gases serve to shorten the time of seal shift.

PRIOR ART CONSTRUCTIONS

Figure 9:
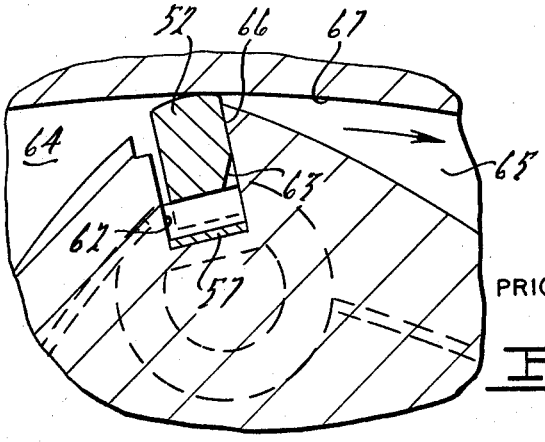
PRIOR ART FIG. 9.

The construction of FIGS. 6–9 is representative of one advanced design in commercial use. The apex seal assembly 50 has three pieces 51, 52 and 53, each of similar width 19. Piece 52 mates with each of the end pieces 51 and 53 along inclined planes 54 and 55 which intersect the top or crown surface 56 at points spaced substantially inward from the side housing walls surrounding the apex seal assembly. As a consequence, it is the center piece 52 which moves up or down to adjust the lateral dimension of the assembly, since end pieces 51 and 53 are restrained against lateral movement (in the direction of arrows 18) by spring 57 engaging the curved shoulders 58 and 59 of the respective end pieces. This results in a gap or slot 60 which allows considerable leakage. Cocking or skewing of the assembly 50 is accepted as a natural occurrence. To communicate pressure to the underside of the assembly, unsymmetrical openings are provided; a groove 61 is defined in one upper lip of the slot 62 at one side and chamfered channels 63 are defined in one lower edge of the center piece 52. The groove and channels are utilized in the hope of allowing gas pressure to act to stabilize the seal upright in the slot and reduce the time-lag. In the leading position of the seal assembly, as shown in FIG. 9, with high pressure in chamber 64, gas forces acting in groove 61 will be effective to shift the end pieces and center piece to the position as shown, with some reduction in time. However, when the apex seal assembly must be returned from the leading position with high pressure in chamber 65, gas pressure cannot penetrate the seal contact along side 66; accordingly, a large time-lag results and lifting of the apex seal from the trochoid surface 67 does occur before it assumes the trailing position of FIG. 8. The spacing between the slot and seal is obviously not critical since considerable slack is allowed to permit skewing. The area of interengagement between the seal pieces and slot walls is large and promotes a soft seal with the possibility of leakage while in either the leading or trailing position.

Figure 10:
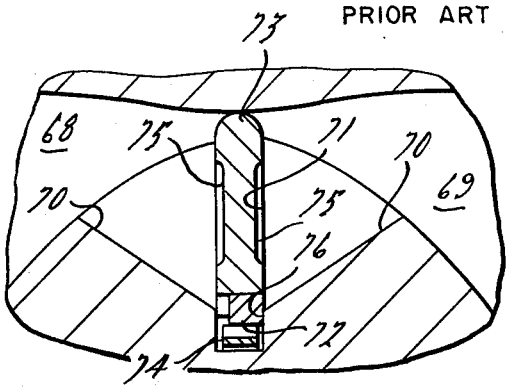
PRIOR ART FIG. 10.
FIG. 10 is a sectional view of another prior art embodiment.

In a second prior art construction as shown in FIG. 10, symmetrically arranged channels or cut-outs 70 are defined in the rotor 77 for communicating gas pressure from chambers 68 or 69 to a shuttle element 72 which performs the sealing function between the sides of slot 71 and the apex seal strip 73. This has proved a hindrance to reducing the time-lag since frictional forces between the shuttle element 72 and the spring 74 or with the seal strip 73 are significant. The shallow symmetrical grooves 75 extend laterally across the entire seal; although facilitating distribution of gas pressure against the mid-section of the seal side when in sealing position, the grooves do not help to break the seal at 76 for the shuttle element with sufficient speed force to overcome the frictional drag. The tolerance between the slot and seal is made too small for much movement; seal shifting is accomplished by the shuttle element and this element does not respond well.

Yet still another prior art structure is shown in FIGS. 11 and 12. Here the three piece arrangement (7, 8 and 9) is comparable in function to the prior art embodiment of FIGS. 6–9, except instead of an asymmetrical arrangement of a groove 61 in the rotor and chamfered channels 63 in the seal, three small recesses 10*a*, 10*b*, 10*c* are defined in the leading and trailing sides (11*a* and 11*b* respectively) of the seal assembly 11. Two of the recesses 10*a* and 10*b* extend across the inclined parting surfaces 12 between the seal pieces. The recesses are positioned on the seal at a height to receive gas pressure from chambers 13 or 14 through the upper margin 15 of each recess; gas pressure is not communicated through the rotor 16. Since the recesses are small in comparison to the lateral length of the seal, gas pressure from chamber 13, when in the leading position, must still pass substantially between seal side 17*a* and the slot wall 18 along the full height of the seal in the slot. The land 6 beneath the central recess 10*c* is not the controlling surface for flow between the seal 11 and slot side walls 17*a* and 17*b*. Accordingly the flow orifice down between the seal and slot is not critically controlled in depth and certainly not uniform in depth. The area of contact between the seal pieces and slot walls is inherently high resulting in low unit clamping forces; the recesses (which extend beyond the upper edge of the slot) cannot be made large since considerable wall material must be left untouched to align the seal in the slot preventing skewing. The mass of the seal pieces, although reduced somewhat, has not been reduced to promote a significant decrease in time lag. Moreover, the placing of two of the recesses (10*a* and 10*b*) over the parting surfaces of the pieces provides a leak path during the momentary seal shift when gas pressure under the seal is not the same as gas pressure in the highest chamber. Tight sealing between the parting surfaces at all times would be possible if the higher gas pressure from a chamber 13 or 14 is instantaneously communicated to the underside of the seal; since the gas flow orifice (that area and depth through which gas flow pressure must pass to reach the underside of the seal) is not sufficient to do this and since unit pressures holding the seal pieces in a sealing position are low, the parting surfaces 12 are not consistently held tight.

INVENTIVE CONSTRUCTION

This invention consists of simultaneously eliminating or reducing at least three primary leakage paths about the apex seal body: (a) eliminate gas leakage that would occur if the seal crown were allowed to leave the epitrochoid chamber surface during a seal shift, (b) eliminate gas leakage between the side of an apex seal and a slot wall that are intended to be sealingly engaged therewith, and (c) reduce gas leakage that travels under the seal between chambers during a seal shift. The first leakage is eliminated by critically controlling spacing between the seal and slot and critically controlling the height or depth of walls defining such spacing, thereby to optimize gas flow efficiency through such spacing and at the same time eliminate tilting of the seal which would affect the gas flow efficiency. The second leakage is eliminated by critically controlling the area of interengagement between a side of the seal and a slot wall so that a high unit pressure force operates to maintain an intended sealed condition. The third leakage is reduced to a negligible condition by reducing the time lapse for a seal shift to take place; such time is reduced by lowering the mass of the seal pieces and by defining pressure surfaces on the seal to respond more quickly to a shift in chamber pressure resulting in better acceleration of the seal during a shift. To optimize flow efficiency of gas pressure from a momentarily higher pressure chamber, down past one seal body side and slot wall, to the zone beneath the seal where pressure may act against the seal bottom to urge the seal crown tightly against surface 21, a flow path or throat exists. For a seal of the prior art this throat has a width 96, length 100 and depth 95. It has been established by study leading to this invention that flow efficiency is directly proportional to flow area (width × length) and inversely portional to the depth of such throat. But the width must be maintained as small as possible to reduce the time of seal shift to as short a duration as possible and the overall height of the seal body in the slot must be quite great to prevent skewing or tilting which would be detrimental to adequate control of the throat area. These seemingly contrary goals are achieved by holding the throat width to 0.001–0.003 inch and contouring the seal body so that the flow throat depth is defined by a narrow land or surface (30*a* or 30*b* of FIG. 18) extending throughout substantially 80% of the overall length of the seal. The land surface results from providing a groove in each of the leading and trailing seal side walls. Thus the throat depth has been reduced significantly from about 0.35 inch for the prior art of FIGS. 13 and 14 to 0.04 inch, since the throat is only that area between surface 33*a* and surface 93*a*.

FIGS. 13–20 compare the operational flow efficiency of a conventional prior art construction and that of this invention. The prior art seal 93 has a width 97 length 100 and overall height 101 equal to the respective overall width 81, length 88 and height 102 of the inventive seal. In FIG. 14, the seal 93 presents a flow throat 105 having said width 96, and said depth 95 defined between seal side wall 93*a* and slot side wall 33*a* (the slots 33 being in rotor 69 and have a width 94). In the leading position of FIG. 14, the seal 93 is in the second or fourth quadrant; gas pressure in chamber 104 is higher and having communicated through the throat 105, urges the crown 93*d* of seal 93 into contact with surface 21 by acting upwardly against surface 93*c* in the lower zone of the slot 33. If the higher gas pressure in chamber 104 had not been communicated sufficiently rapidly through throat 105, a slightly lower pressure differential will allow gas pressure to leak through path 107 created between crown surface 98*d* and the epitrochoid surface 21 (see FIG. 16). The long length of throat 105 creates a viscous drag on the gas flow to significantly reduce flow efficiency; this cannot simply be alleviated by making the cross-sectional area of the throat larger even though this is how the prior art has approached the problem.

The higher gas pressure also acts sideways against surface 93*a* to promote a sealing engagement between surface 93*b* and 33*b*. This engagement may not be perfect since the available pressure force is spread across a large area (dimensions 95 × 100) resulting in a low average unit pressure load of only about 125 psi (assuming typical pressure variation in chamber 104 varies between 0 and 550 psi). A variety of interfering forces may cause this low average unit load to be overcome resulting in slight opening of throat 106 as shown in FIG. 15. There is thus created a leak path through throat 105, under the seal, and through throat 106 (even though the crown remains sealed). With use of the seal of FIG. 17, the average unit pressure load is increased to about 1078 psi under the same conditions.

The time of travel from the position of FIG. 14 to the position of FIG. 16 is related to the distance to be traveled as well as the mass. The distance typically is 0.006 inch or greater for the prior art and the mass is high because of the lack of significant cut-outs or recesses. The time of travel is typically on the order of $4.21 \times 10^{-4}$ seconds. This is at least triple the time internal attained by use of this invention. Leakage during this shift period is proportional to this time interval. Typically the seal of FIG. 13 will allow $7.2 \times 10^{-6}$ lbs. (flow rate × time) and the leakage volume will be about 0.18 $in^3$. With the seal of FIG. 17, the leakage will be less than $1.30 \times 10^{-6}$ lbs. and the leakage volume will be less than 0.03 $in^3$.

Turning specifically to FIGS. 17–20, the improved sealing characteristics accrue considerably from the presence of deeply penetrating and elongated grooves 35. The grooves have a height 83 (typically about 0.19 in.), a length 48 (about 80% of the length of the seal), a lateral width 84 (about ⅓ of the width of the seal and generally equal to the width 86 of the seal web). The grooves are sized to reduce the volume and thereby the mass of the unexposed seal body portion by at least 35%.

The interengaging surface area between the seal body and slot wall is that area from line 92 (shown in broken outline in FIG. 17) which corresponds to the top edge of the slot, to the bottom of the seal less the area of the groove 35. The contact area of the seal above the groove, with the slot side wall is narrow, typically about 0.006 inches (see height 91). The uninterrupted interengaging area is at least 40% less than the full seal side area (uninterrupted interengaging area is defined to be that side area on piece 30 independent of the area on piece 29). The full side area along the unexposed side of the seal in the slot is at least 4–7 times the side area of the exposed portion of the seal.

The throat 108 has a width 82, a length 88, and a height 85 for at least 80% of said length. The height 85 is typically 0.04 inch, the width 0.001–0.003 inch and the length typically 2.7–3.6 inches. The throat width is determined by the difference between the slot width 80 and seal width 81 (typically about 0.25 inch). The critically controlled throat surface is land **30*a* or 30*b* (0.04 inch) which determines the height of the throat. The zone between the seal body portion and slot bottom has a height 87** which must be at least 0.02 inches.

In operation, and starting in the seal position of FIG. 18, the highest gas pressure is in chamber 104 and has been fully communicated to the zone beneath the seal 30. The gas pressure applied upwardly against the bottom of the seal results in a very high unit load at the small contact area between the crown **30*e* and surface 21. Similarly the gas pressure acting against the surfaces 30*a* and 30*f* and the surfaces defining groove 35*a* (adding up to the full height of seal and full length of seal) result in a high unit load concentrated only at interengaging surface 30*b* and a small part of surface 30*d* (that which is in the slot and not overlapped with a passage 34 plus the small surfaces beyond the grooves 35. When the higher gas pressure condition shifts to chamber 103, the surfaces defining groove 35*b* become an actuator receiving the force the high gas pressure through passage 34. The vector of such force is centered through the center of mass of seal 30 causing it to move laterally to the left without skewing to an intermediate position shown in FIG. 19. The high pressure now passes through short throat 109 with such speed that there is essentially no time-lag in the variance of pressure in conformity with chamber 103 pressure. The leak path around and below the seal, evident in FIG. 19, is allowed to exist for a lesser period of time than by the prior art due to the reduced mass of seal 30 and the increased flow efficiency of throat 109. Thus, the seal assumes the alternate sealing position of FIG. 20 with little or no relief in pressure below to seal to allow crown 30*e* to leave surface 21**.

Turning now to FIGS. 1–4, the inventive structure shall be redescribed with greater particularity, utilizes a mechanical design concept which allows the apex seal assembly 20 to be stable in the rotor slot during its movement from a leading to a trailing position and which movement is activated by gases from both combustion chambers as required with no time-lag; in a sealing position, the seal is tight with elimination of leakage. This is accomplished by designing the apex seal strip 30 to have a cross-section, throughout its greater central portion of its longitudinal extent 25, which is similar in configuration to that of an "I" beam (see FIGS. 3 and 4). In addition, the lips or edges 31 and 32 of the slot 33, within which the seal assembly resides, is provided with one or more communicating passages 34 in each leading and trailing slot side wall so that combustion chamber gas pressure can communicate through the passages 34 to recesses or grooves 35 defining the "I" beam cross-sectional configuration and thereby exert a force to shift the seal while breaking its sealing effect with the instant slot wall. The communicating passages 34 do not penetrate to a depth which would interrupt a critical lower gas seal between bottom side portion **30*a* or 30*b* of the seal strip and the slot side 31 or 32. When gas pressure builds up along either the closed trailing or closed leading side, the gases will operate in the groove of the "I" cross-section to urge the strip laterally away from the closed side and thereby permit said gas pressure to penetrate instantaneously to the underside 30*c* of the "I" beam cross-section across short land surface 30*a* or 30*b***.

The apex seal assembly 20 particularly has two pieces 30 and 29 constituting the strip; each piece is constructed of a material such as cast iron or a composite or titanium carbide, and graphite. Each piece mates with the other at an incline plane 36 which allows for lateral adjustment between side housings 37 and 38. One edge **36*a* of the inclined plane intersects at the side face 39 of the seal assembly and another edge 36*b* of the incline plane intersects with an intermediate point of the bottom recess 40 inside of the spring contact area. No leakage gap can occur between the crown 28 of the strip and the trochoid surface 21 of the rotor housing simply as a result of lateral adjustment of the two pieces 30 and 29**.

Figure 1:
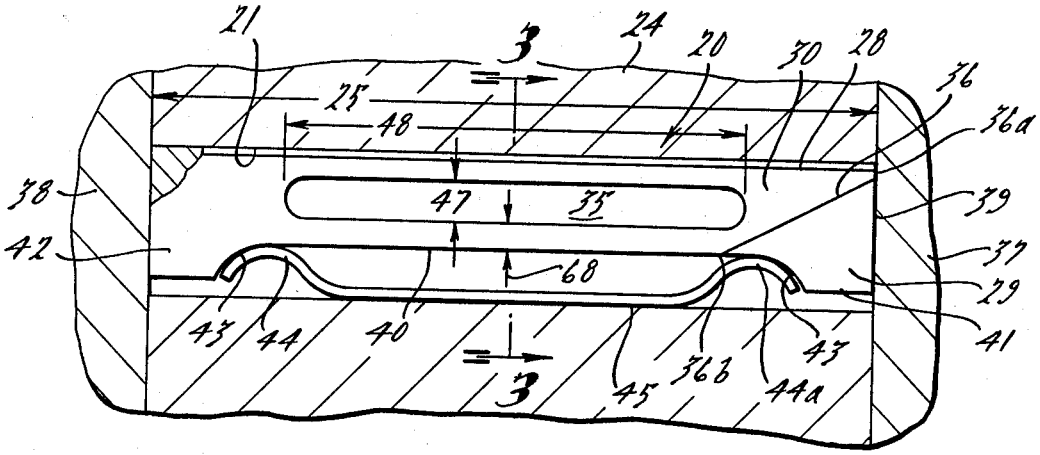
FIG. 1 is a fragmentary cross-sectional view of a portion of a rotary internal combustion engine embodying the present invention, the view taken in a manner to expose an elevational view of one apex seal assembly.
Figure 2:
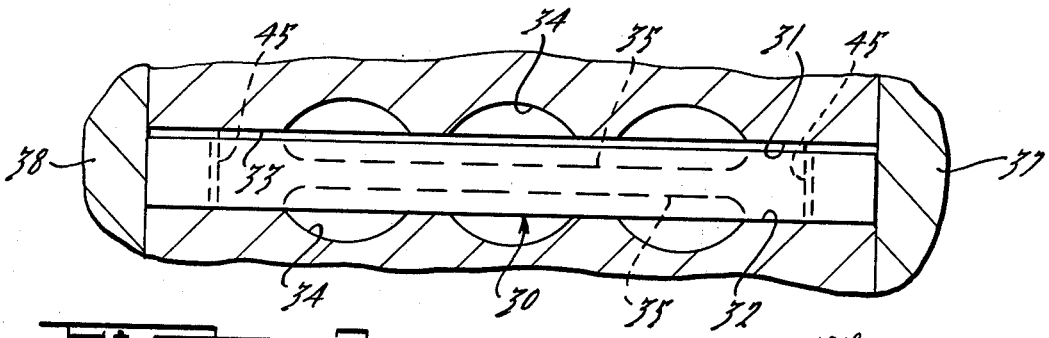
FIG. 2 is a plan view of the structure of FIG. 1.

The recess 40 defines legs 41 and 42 at opposite ends of the bipartite seal; curved segments 43 of the seal at corners of the recess 40 receive the ends **44*a* of a compression spring 45, as that shown in FIG. 1. The spring 45 is reduced in force to about 5 lbs. compared to the need for a 13 lb. spring force in prior art construction. There is at least about a ⅓ reduction in spring force. Some trapped gases beneath the seal during a seal shift permits another ⅓ reduction in spring force. The width 46 of each piece is uniform. Grooves 35 are defined in both sides of piece 30 having a height dimension 47 which is about one-half the height of the seal and a length 48 which terminates the grooves just short of the elevational projection or corner seals 78 leaving a space of about 0.040–0.060 inch. Deep corner seals are preferred to obtain better sealing. This eliminates the possibility of gas leakage from the grooves 35 through the corner seal construction. It is critical that the grooves 35 and passages 34 be symmetrically arranged. Sealing lands or side portions 30*a* or 30*b* (between grooves 35 and the recess 40) have a vertical dimension 68** which is about 0.04 inches in this embodiment and has a longitudinal dimension which is commensurate with the length of the groove.

The seal assembly 20 is stable in the groove because of the very close tolerance between the seal pieces and the groove (0.002 inch); close tolerance is permitted because gas pressure can instantaneously actuate movement of the apex seal. No longer must the seal tolerate a canting or skewing action since the vector of gas pressure in the grooves 35 operates through the center of mass for the apex seal.

The communicating passages 34 are defined in the rotor 69 at the top edges of slot walls 31 and 32; they are here formed with a hemi-spherical cross-section and sized to allow gas pressure changes to be sensed with no time delay. It is important that the communicating passages 34 penetrate no longer than the bottom edge 35*a* of the recess or groove in the sides of the apex seal piece 30 whereby a complete surface contact may be maintained between the lower portions or lands 30*a* or 30*b* and the sides of the slot.

At no time is there a net radial force acting on the apex seal which is zero or negative. The amount of high pressure gas acting on the small exposed crown portion (radially inward) is counter balanced by gas pressure acting underneath the seal at surface 30*c;* the gas pressure force acting against the sides of the seal is considerably greater than any frictional force due to the spring 45 because of the critical lower zone sealing at lands 30*a* or 30*b;* there is no cocking of the seal. Should this ever become a problem in design, the upper and lower surfaces 35*b* and 35*c* of the grooves 35 can be arranged so that a force component is set up in addition to the spring force to counteract any pressure acting on the crown to insure neutral or balanced forces in the radial direction thereby permitting only a positive lateral force to shift the seal under a stabilized movement.

Results from oscilloscope traces (FIG. 21) for the construction shown in FIG. 13 at 5,000 r.p.m. show a time-lag of 30%; this is in contrast to oscilloscope traces (FIG. 22) for the construction according to the preferred embodiment (FIGS. 1–4) herein which shows a 0% time-lag. In addition, the preferred construction increases the peak pressure in the combustion chamber by approximately 150 psi, although such increase can be even further increased.

Figure 23:
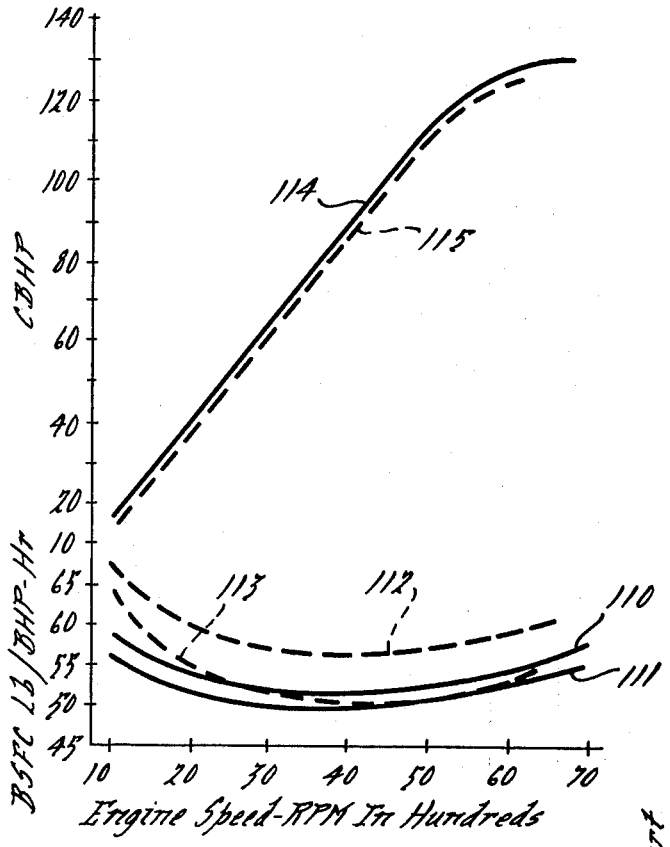
FIG. 23 is a graphical representation of horsepower and fuel consumption plotted against engine speed, for the embodiment of FIGS. 1–4.
Figure 25:
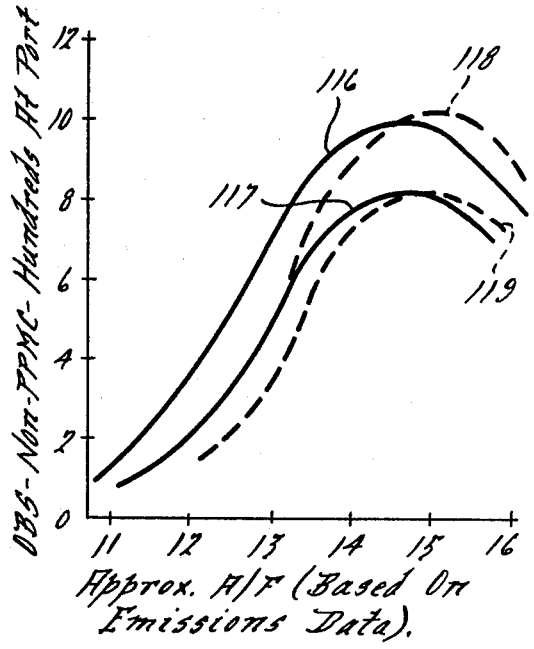
FIGS. 24 and 25 are graphical representations of emissions plotted against air/fuel ratio for the embodiment of FIGS. 1–4 (Hydrocarbons and $NO_x$ respectively).
Figure 24:
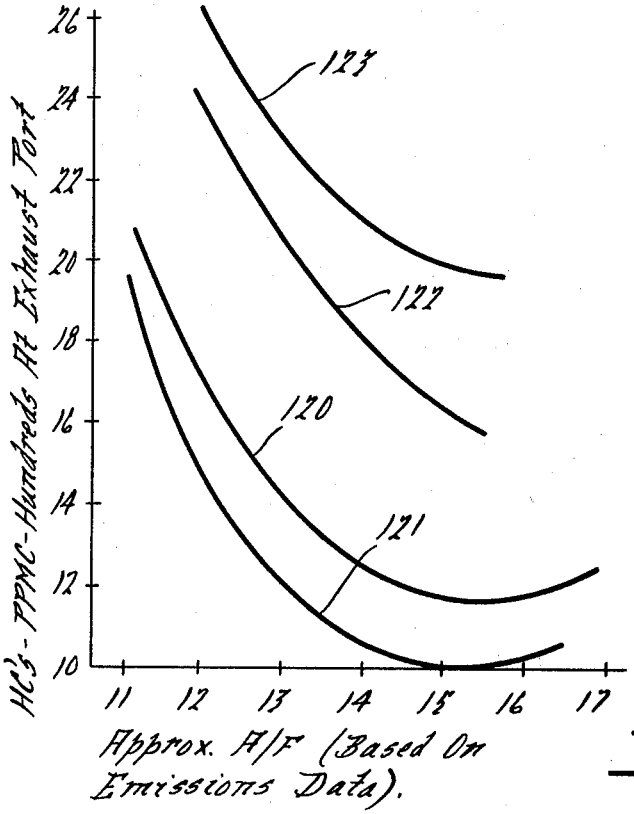

The specific advantages which flow from the use of the construction of this invention, of course, reside principally in lower fuel consumption and lower emissions. As shown graphically in FIG. 23, Brake Specific Fuel Consumption for the present invention (shown in area between solid lines 110 and 111) is lower than that for an engine equipped with the best of commercially available apex seals (shown in area between broken lines 112 and 113); the Calculated Brake Horsepower is higher for the instant invention (solid line 114) than for commercially available seals (broken line 115). In FIG. 25 $NO_X$ emitted by an engine equipped with the present invention was equivalent at an air/fuel ratio of 14.4 but lower for leaner air/fuel ratios (solid lines 116 and 117 for rotors 1 and 2) than for an engine with commercial apex seals (broken lines 118 and 119 for rotors 1 and 2). More dramatic is the lower hydrocarbons (FIG. 25) for an engine equipped with the present invention (solid lines 120 and 121 for rotors 1 and 2) as compared with a standard commercial rotary engine (solid lines 122 and 123 for rotors 1 and 2).

I claim:

1. In a rotary internal combustion engine having a rotor with slots and gas communicating channels, said slots having flat leading and trailing side walls arranged in a generally radial direction with respect to the rotor center of rotation, and having a predetermined width, length and depth, each communicating channel extending between the rotor outer surface and an interior location of one of said slots, an apex seal comprising:

(a) a crown portion extending out of said slot, (b) a unitary impervious body portion residing within said slot having leading and trailing side walls carrying grooves extending at least 80% the length of said body portion and extending into the body portion a depth at least 33% of the width of said body portion, and extending a height sufficient to leave an uninterrupted residual side wall surface below said groove which is substantially about 0.04 inch, and (c) means providing length adjustment of said seal in conformity with any variance of the spacing between ends of said rotor slots.

2. The combination as in claim 1, in which the space tolerance between said the width of said slot and width of said seal body portion at said residual side wall surfaces is 0.001–0.003 inch.

3. In a rotary engine having at least one chamber defined by flat parallel side walls and a lobed epitrochoid end wall, a rotor occupying substantially the entire spacing between the chamber side walls and having a peripheral end wall with apices defining variable volume spaces with said chamber, said rotor having slots spaced along the rotor end wall for carrying seal assemblies to promote a dynamic gas seal between said rotor apices and the chamber walls, an apex seal assembly fitting within each slot having a seal strip with a crown extending out of the slot and a body extending into the slot, the seal strip body having a length extending through substantially the full spacing between said chamber side walls, said seal strip body having camming means providing adjustment for the seal strip length in conformity with any adjustment in the spacing between chamber side walls, said camming means not interrupting the seal crown, the combination comprising:

(a) leading and trailing slot side wall portions in said rotor defining the lower zone of each of said slots, (b) leading and trailing seal strip body side wall portions in said slot spaced apart a distance to define a flow orifice between said slot side walls and seal strip body which is no less than 0.001 inch and no greater than 0.003 inch in width, said seal strip body side wall portions extending into said slot a distance sufficient to define a side surface area which is at least four times but not greater than seven times the side area of said seal crown out of the slot, (c) walls defining grooves in each of said leading and trailing strip body side wall portions, said grooves extending lengthwise of said seal strip and being arranged symmetrically on opposite sides thereof, said grooves reducing the volume of said seal strip body independent of said camming means by at least 40% and reducing the side surface area of said seal strip body to define an interengaging side surface area engageable with a leading or trailing side wall portion of the slot by at least 25%, said grooves defining a land surface between the bottom extremity of said seal strip body and said grooves which has a height dimension no greater than 0.04 inches, and (d) gas pressure communicating means effective to continuously communicate chamber gas pressure on either side of said seal assemblies with said grooves, whereby variations in the highest gas pressure on either side of said seal assemblies may be communicated to the underside of said seal body through said flow orifice with substantially no time lag thereby maintaining an optimum pressure force under said seal body to maintain a continuous tight seal of said seal crown against the chamber end wall and to shift said seal strip body between said slot side walls with greater speed to reduce pressure leakage between said seal strip and slot, and further to provide an increase in unit pressure force holding said seal strip interengaged with a slot side wall for preventing interruption of the intended interengagement between seal strip body and slot side walls.

4. The combination as in claim 3, in which said gas pressure communicating means comprising a series of independent passages chamfered out of the upper lip of each slot side wall.

5. The combination as in claim 3, in which the height and length of said grooves is arranged to provide a total uninterrupted residual side wall surface of no greater than 60% of the body portion side wall without the groove.

* * * * *